US008175478B2

(12) United States Patent
Okumura et al.

(10) Patent No.: US 8,175,478 B2
(45) Date of Patent: May 8, 2012

(54) IMAGE FORMING APPARATUS CONTROLLING THE POSITION OF A CONVEY MEMBER WITH RESPECT TO THE TONER IMAGE POSITION BASED ON SENSED INDICIES

(75) Inventors: Ichiro Okumura, Abiko (JP); Jiro Shirakata, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 261 days.

(21) Appl. No.: 12/625,850

(22) Filed: Nov. 25, 2009

(65) Prior Publication Data

US 2010/0142984 A1 Jun. 10, 2010

(30) Foreign Application Priority Data

Dec. 5, 2008 (JP) ..... 2008-310571

(51) Int. Cl.

| | |
|---|---|
| ***G03G 15/16*** | (2006.01) |
| ***G03G 15/00*** | (2006.01) |
| ***G03G 15/01*** | (2006.01) |
| ***G03G 15/20*** | (2006.01) |

(52) U.S. Cl. ..... 399/66; 399/26; 399/303; 399/312; 399/313; 399/316

(58) Field of Classification Search ..... 399/26, 399/66, 303, 312, 313, 316
See application file for complete search history.

(56) References Cited

U.S. PATENT DOCUMENTS

2009/0123197 A1* 5/2009 Okumura et al. ..... 399/301

FOREIGN PATENT DOCUMENTS

| | | | |
|---|---|---|---|
| JP | 2003-173091 | A | 6/2003 |
| JP | 2004-78016 | A | 3/2004 |
| JP | 2004-145077 | A | 5/2004 |
| JP | 2006-301007 | A | 11/2006 |

OTHER PUBLICATIONS

Yamamoto et al., OKI Technical Review—Electrophotographic Color Printer Engine, Aug. 1998, vol. 64.*

* cited by examiner

*Primary Examiner* — David Gray
*Assistant Examiner* — Joseph S Wong
(74) *Attorney, Agent, or Firm* — Fitzpatrick, Cella, Harper & Scinto

(57) ABSTRACT

An image forming apparatus includes an image bearing member; a transfer portion that transfers a toner image; a conveying member that conveys a recording material; a conveying member position index sensing member that senses a conveying member position index fixed to the conveying member in the transfer portion; a toner image position index sensing member that senses a toner image position index fixed to the image bearing member in the transfer portion; a drive member that can control a position of the conveying member in a moving direction of the conveying member and a rotating speed of the conveying member; and a control portion that controls the drive member to position the conveying member position index with respect to the toner image position index reaching the transfer portion based on the sensing results of the conveying member position index and the toner image position index.

2 Claims, 10 Drawing Sheets

IMAGE FORMING APPARATUS CONTROLLING THE POSITION OF A CONVEY MEMBER WITH RESPECT TO THE TONER IMAGE POSITION BASED ON SENSED INDICIES

BACKGROUND OF THE INVENTION

1. Field of the Invention

The present invention relates to an image forming apparatus that transfers a toner image to a recording medium to form an image. Particularly the invention relates to control in which, in order to enhance the image formation, a distortion of the toner image is corrected to transfer the toner image to the recording medium.

2. Description of the Related Art

In an electrophotographic system image forming apparatus, the toner image on a photosensitive drum or an intermediate transfer belt, which is of an image bearing member, is transferred to a recording material to form the image.

Usually, in the image forming apparatus, the control is performed such that a time the toner image reaches a transfer portion is matched with a time the recording material reaches transfer portion. The toner image on the photosensitive drum or intermediate transfer belt, which is of the image bearing member, partially expands or shrinks by a speed fluctuation of the photosensitive drum or intermediate transfer belt. When the expanded or shrunk toner image is directly transferred, the expansion or shrinkage of the image remains on the recording material. Therefore, for example, Japanese patent Application Laid-Open No. 2004-78016 discloses a technique of solving the problem.

In the technique disclosed in Japanese patent Application Laid-Open No. 2004-78016, a position detecting pattern formed in the intermediate transfer belt is detected, and a speed of the intermediate transfer belt is determined from the time a leading end of the position detecting pattern passes, the time a rear end of the position detecting pattern passes, and a distance between the leading end and the rear end. On the other hand, a leading end and a rear end of the recording material are detected, and a speed of the recording material is determined from the time the leading end of the recording material passes, the time the rear end of the recording material passes, and a length of the recording material. The driving of the intermediate transfer belt and the driving of the recording material are controlled according to the speed of the intermediate transfer belt and the speed of the recording material.

However, only the average speed is determined in the technique disclosed in Japanese patent Application Laid-Open No. 2004-78016. Therefore, not only the control is hardly performed according to the minute, small speed fluctuation, but also the partial expansion or shrinkage of the image is hardly corrected.

The following methods are disclosed in order to solve the problems in a tandem type image forming apparatus, in which plural image bearing members having different development colors are arranged along a conveying member (such as an intermediate transfer belt and a recording material conveying belt) to form a full-color image.

That is, in the control technique with high accuracy, a recording layer is provided in each of a first photosensitive drum and a second photosensitive drum, and a first position index and a second position index are recorded in synchronization with write of a scanning line. On the other hand, a recording layer is also formed in the intermediate transfer belt, and a conveying member position index is recorded in the intermediate transfer belt every time the first position index is sensed in a primary transfer portion of the first photosensitive drum.

In the primary transfer portion of the second photosensitive drum, a determination of the advance or delay of the corresponding second position index is made every time the conveying member position index is read, and a rotating speed of the second photosensitive drum or a position along a rotating direction of the intermediate transfer belt is adjusted to superimpose a first color toner image and a second color toner image.

There is another technique of controlling the speed of the photosensitive drum to align the positions of the toner images (for example, see Japanese patent Application Laid-Open Nos. 2004-145077, 2003-173091, and 2006-301007).

In the conventional techniques, the color toner images can accurately be superimposed in the transfer portion. At the same time, disadvantageously the partial expansion or shrinkage of the toner image is enlarged because of the adjustment of the photosensitive drum.

SUMMARY OF THE INVENTION

The present invention provides an image forming apparatus that suppresses the partial expansion or shrinkage of the toner image while accurately superimposing the color toner images in the transfer portion.

The representative configuration in the invention for solving the above problems is an image forming apparatus including: an image bearing member that moves a toner image while bearing the toner image; a transfer portion in which the toner image is transferred from the image bearing member to a recording material; a conveying member that conveys the recording material to the transfer portion while moving integral with the recording material; a conveying member position index sensing member that senses a conveying member position index at a position close to the transfer portion, the conveying member position index being fixed to the conveying member as a periodic pattern along a moving direction of the conveying member; a toner image position index sensing member that senses a toner image position index at a position close to the transfer portion, the toner image position index being fixed to the image bearing member as a periodic pattern along a moving direction of the image bearing member according to the toner image; a drive member that can control at least one of a position of the conveying member in the moving direction of the conveying member and a rotating speed of the conveying member; and a control portion that controls the drive member to position the conveying member position index with respect to the toner image position index reaching the transfer portion based on the sensing results of the conveying member position index and the toner image position index.

Further features of the present invention will become apparent from the following description of exemplary embodiments (with reference to the attached drawings).

DESCRIPTION OF THE EMBODIMENTS

[First Embodiment]

Figure 1:
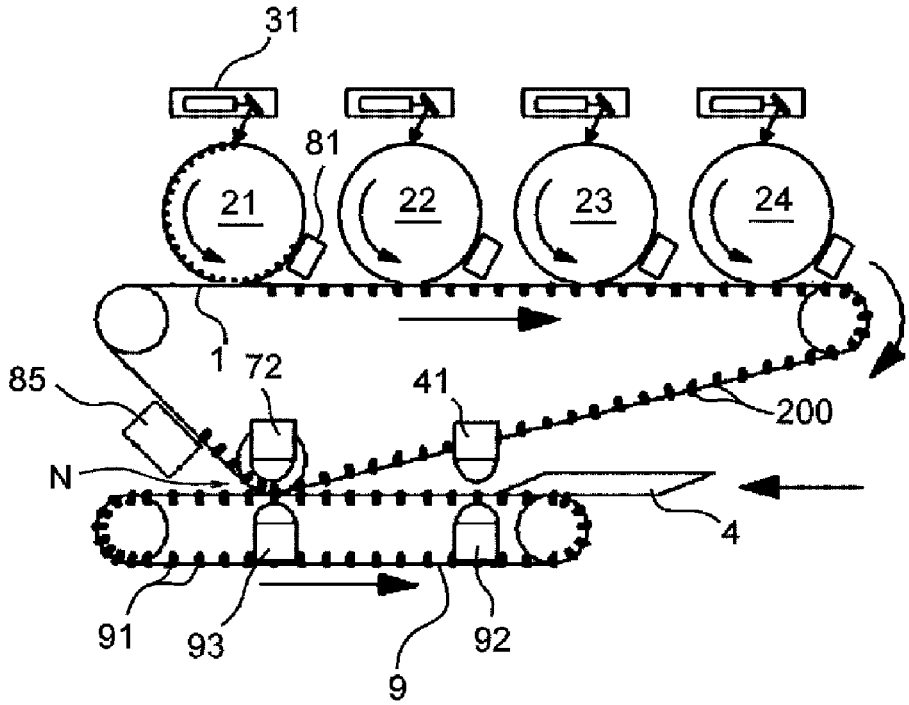
FIG. 1 is a schematic diagram illustrating an image forming apparatus according to a first embodiment of the invention.

FIG. 1 is a schematic diagram illustrating an image forming apparatus according to a first embodiment of the invention.

Usually, in a tandem type image forming apparatus, the intermediate transfer belt or photosensitive drum is used as the image bearing member to bear the toner image. In the first embodiment, at least four photosensitive drums are arranged on one intermediate transfer belt 1. The images having different colors are formed on the photosensitive drums, respectively. In the first embodiment, an image having a color of yellow Y is formed on a first photosensitive drum 21, an image having a color of magenta M is formed on a second photosensitive drum 22, an image having a color of cyan C is formed on a third photosensitive drum 23, and an image having a color of black Bk is formed on a fourth photosensitive drum 24.

A configuration and an operation of an image forming portion will be described by illustrating the photosensitive drum 21 and surroundings thereof. Although not illustrated, process portions that act on the photosensitive drums 21, 22, 23, and 24 are disposed around the photosensitive drums 21, 22, 23, and 24. For example, the process portion includes a charging device that evenly charges the surface of the photosensitive drum, an exposure member that emits a laser beam to form a latent image, a development device that supplies toner to the latent image, and a cleaning member that cleans the toner remaining on the photosensitive drum after primary transfer.

As illustrated in FIG. 1, the first photosensitive drum 21 is rotated in an arrow direction (counterclockwise) at a substantially constant speed by a motor (not illustrated). The charging device evenly charges a photosensitive material on the surface of the photosensitive drum.

Then a first exposure member 31 scans the first photosensitive drum 21 with the laser beam in response to an image signal. Therefore, a potential at a laser beam irradiation position is changed in the surface of the first photosensitive drum 21, and a first latent image is formed on the first photosensitive drum 21.

The laser beam scanning forms the first color image to be printed, and the laser beam scanning forms an image position scale 201 (toner image position index) as a periodic pattern outside an image region of the first photosensitive drum 21. The image position scale 201 is periodically formed along the rotating direction of the first photosensitive drum 21. For example, a scale having a pitch of about 84 μm is written when a scale of line/space of 600 dpi is formed by the laser beam scanning.

Figure 2:
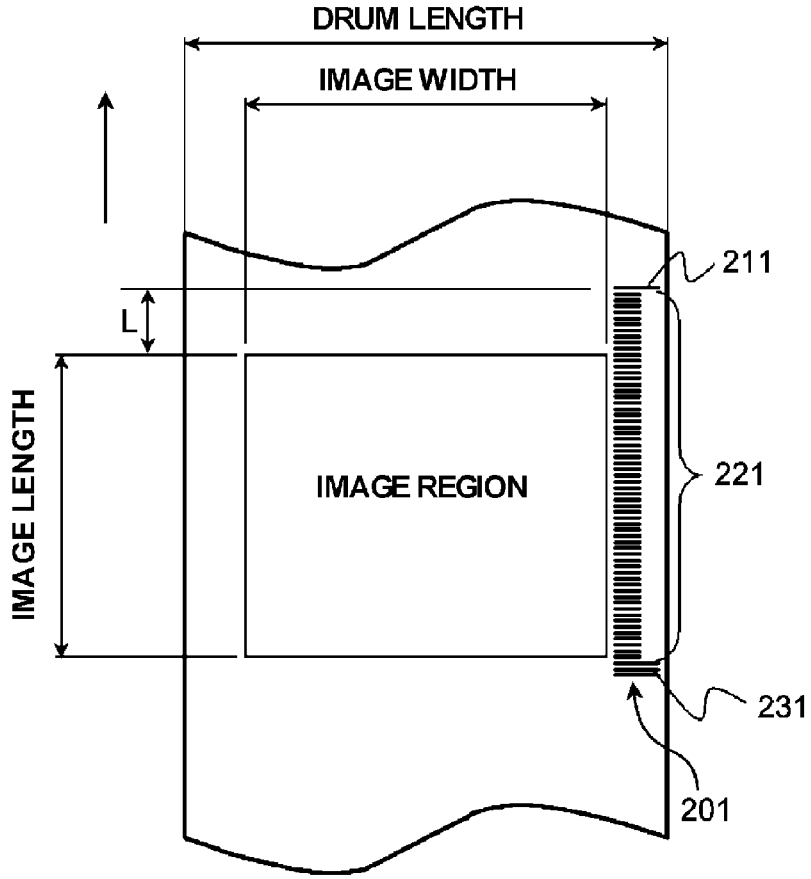
FIG. 2 is a development view of a surface of a photosensitive drum.

The image position scale 201 will be described below. FIG. 2 is a development view of a surface of the photosensitive drum, and FIG. 2 also illustrates a positional relationship between the print image and the image position scale 201 formed in the photosensitive drum.

The image position scale 201 includes an image position information starting mark 211, an image position mark 221, and an image position information ending mark 231.

The image position information starting mark 211 is written in advance of the print image by a predetermined distance L. The image position mark 221 is periodically written subsequent to the image position information starting mark 211. The image position information ending mark 231 is written so as to correspond to a first color print image ending position.

A development device (not illustrated) causes the yellow toner to adhere to the first color print image and the portion in which the potential is changed by the laser beam irradiation of the image position scale 201, thereby forming a first image (yellow Y). The toner used to form the first image is transferred onto the intermediate transfer belt 1. The transfer is performed in the primary transfer portion in which the first photosensitive drum 21 and the intermediate transfer belt 1 come into contact with each other.

Figure 3:
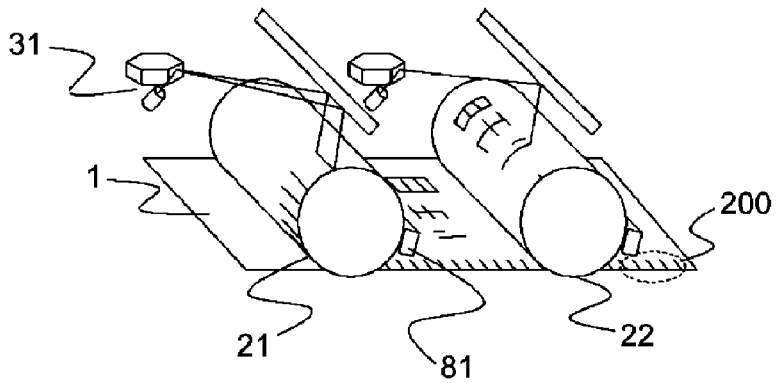
FIG. 3 is a perspective view illustrating a state in which an image is transferred from the photosensitive drum to an intermediate transfer belt.

FIG. 3 is a perspective view illustrating a state in which the image is transferred from the photosensitive drum to the intermediate transfer belt. In FIG. 3, the third photosensitive drum 23 and the fourth photosensitive drum 24 are omitted.

As illustrated in FIG. 3, the image position scale 201 on the first photosensitive drum 21 is transferred onto the intermediate transfer belt 1. An image position information erasing member 81 erases the residual toner after the image position scale 201 is transferred. The image position information erasing member 81 may also act as the cleaning member that erases the residual toner image.

The image position scale 201 on the first photosensitive drum 21 is transferred onto the intermediate transfer belt 1 to become an image position scale 200 (toner image position index). As with the image position scale 201 on the photosensitive drum, the image position scale 200 on the intermediate transfer belt 1 includes an image position information starting mark 211, an image position mark 221, and an image position information ending mark 231.

Then the image position scale 200 is conveyed to a secondary transfer portion (transfer portion N) along with the first color print image. As illustrated in FIG. 1, an image information erasing member 85 is provided on a downstream side of the secondary transfer portion of the intermediate transfer belt 1, and the image information erasing member 85 erases the toner image on the intermediate transfer belt 1 or the image position scale 200.

On the other hand, referring to FIG. 1, a conveyed recording material 4 is electrostatically sucked onto a recording material conveying belt 9. The recording material 4 electrostatically sucked to the recording material conveying belt 9 is conveyed to a secondary transfer portion while integrated with the recording material conveying belt 9. The secondary transfer portion is a point at which the intermediate transfer belt 1 and the recording material conveying belt 9 abut on each other. In the secondary transfer portion, the intermediate transfer belt 1 and the recording material 4 come into close contact with each other. Therefore, the toner image on the intermediate transfer belt 1 is transferred to the recording material 4.

At this point, a transfer roller (not illustrated) brings the recording material 4 on the recording material conveying belt 9 into press-contact with the side of the intermediate transfer belt 1. A voltage having a charging polarity opposite the toner is applied to the transfer roller in order to promote the transfer of the charged toner from the intermediate transfer belt 1 to the recording material 4.

An equal pitch scale is previously printed in the recording material conveying belt 9. For example, equal pitch scale 91

(conveying member position index) that is of a correct scale having a pitch of 84 μm is printed or impressed.

A drive member (not illustrated) such as a gear and a motor drives the recording material conveying belt 9. A control portion including CPU can control the drive member.

A position control operation in transferring the image on the intermediate transfer belt 1 to the recording material 4 will be described below.

An end-portion sensor 41 and a read head 92 (second conveying member position index sensing member) are disposed at the substantially same position so as to be located across the recording material conveying belt 9 in a region where the recording material 4 is conveyed. The end-portion sensor 41 and the read head 92 are disposed on the upstream side of (in front of) the secondary transfer portion in the moving direction of the recording material conveying belt 9.

When the recording material conveying belt 9 starts to move, the read head 92 detects the equal pitch scale 91 on the recording material conveying belt 9 one after another. When the read head 92 detects the equal pitch scale 91, a detection signal supplied from the read head 92 is stored as an address counted from a reference point of the recording material conveying belt 9 in a storage member (not illustrated).

When sensing a front end of the recording material 4, the end-portion sensor 41 supplies a signal as the sensing result. Therefore, an address located in advance of an address (recording material end portion address) of the equal pitch scale 91 on the recording material conveying belt in the storage member by a predetermined distance L is sent to the control portion. That is, address (control starting address) that should be matched with the image position information starting mark 211 is computed and sent to the recording material conveying belt control portion.

As illustrated in FIG. 1, a read head 72 (toner image position index sensing member) and a read head 93 (conveying member position index sensing member) are disposed at positions that are close to the secondary transfer portion. The read head 72 detects the image position scale on the intermediate transfer belt 1. Specifically, the read head 72 and the read head 93 are disposed at the substantially same position so as to be located across the recording material conveying belt 9 in the conveying direction of the recording material conveying belt 9.

The read head 72 reads the image position mark 221 subsequent to the image position information starting mark 211, and the read head 72 sends a read signal of the image position mark 221 to the control portion. The image position mark 221 is a mark corresponding to the position of the scanning laser beam, that is, the position of the print image.

The read head 93 reads the equal pitch scale 91 on the recording material conveying belt, and the read head 93 sends a read signal of the equal pitch scale 91 to the control portion.

The control portion controls the speed or position of the recording material conveying belt 9 such that a difference of the read time between the initial image position information starting mark 211 on the intermediate transfer belt 1 and the scale having a control starting address on the recording material conveying belt 9 is brought close to zero. Further, the control portion controls the speed or position of the recording material conveying belt 9 such that the difference of the read time between the subsequent image position mark 221 on the intermediate transfer belt 1 and the equal pitch scale 91 on the recording material conveying belt 9 is brought close to zero. Specifically, the control portion controls the drive member of the recording material conveying belt 9 to adjust the speed or position of the recording material conveying belt 9.

Figure 4:
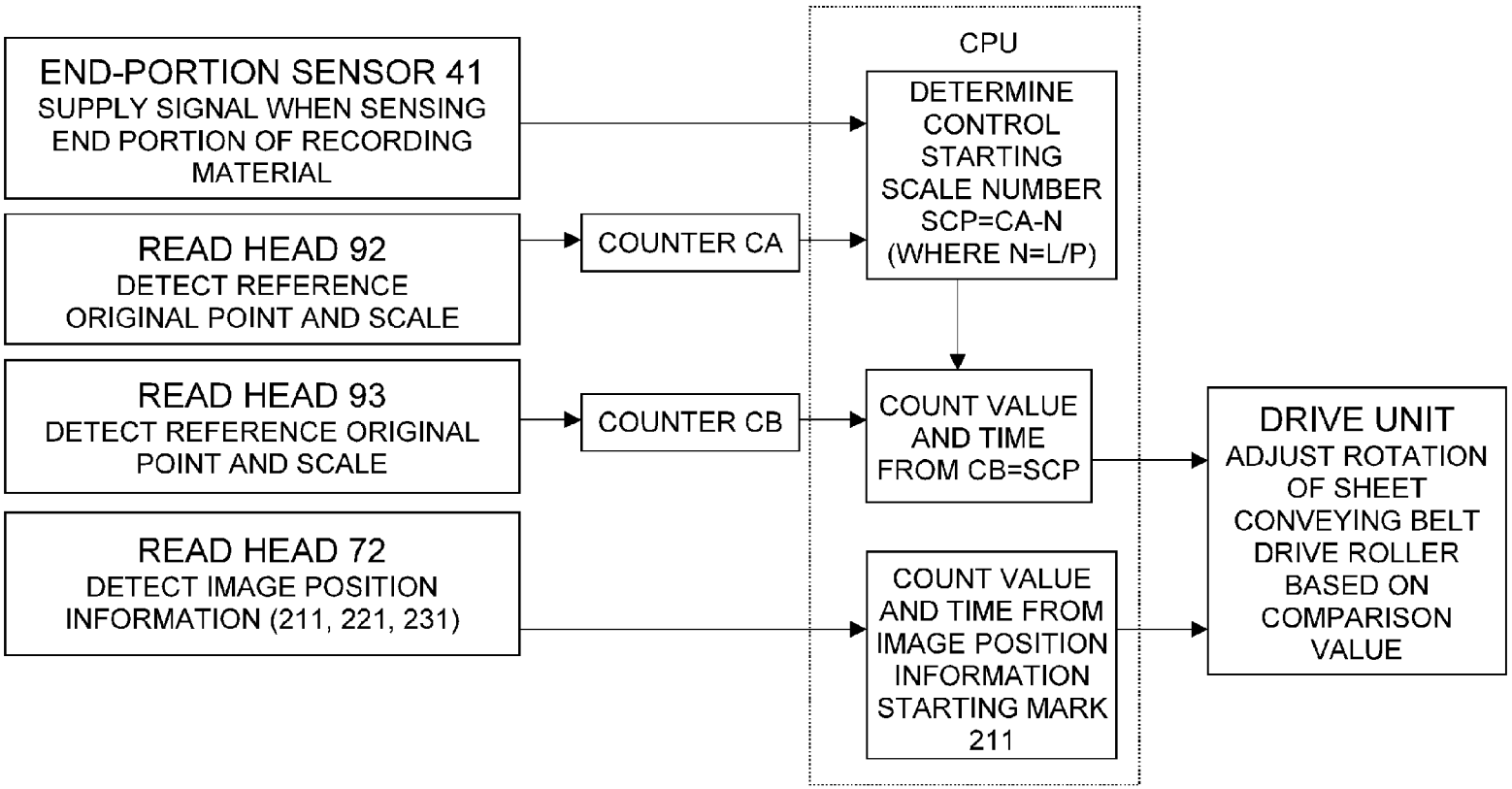
FIG. 4 illustrates a control block of the first embodiment.

An outline of the control will be described with reference to FIG. 4. FIG. 4 illustrates a control block of the first embodiment.

The position of the end portion of the recording material is brought into correspondence with the equal pitch scale 91 using the read head 92 and the end-portion sensor 41. A scale number (SCP) whose position should be matched with the image position information starting mark 211 of the image position scale 200 is determined by a scale number at which the scale matching starts, that is, a scale number located ahead by a distance L from the image.

Using the read head 93 and the read head 72, the control portion compares a pulse count value read by the read head 93 with a pulse count value read by the read head 72. The control portion controls the rotation of the recording material conveying belt drive roller such that a difference between the pulse count values is reduced.

Figure 5:
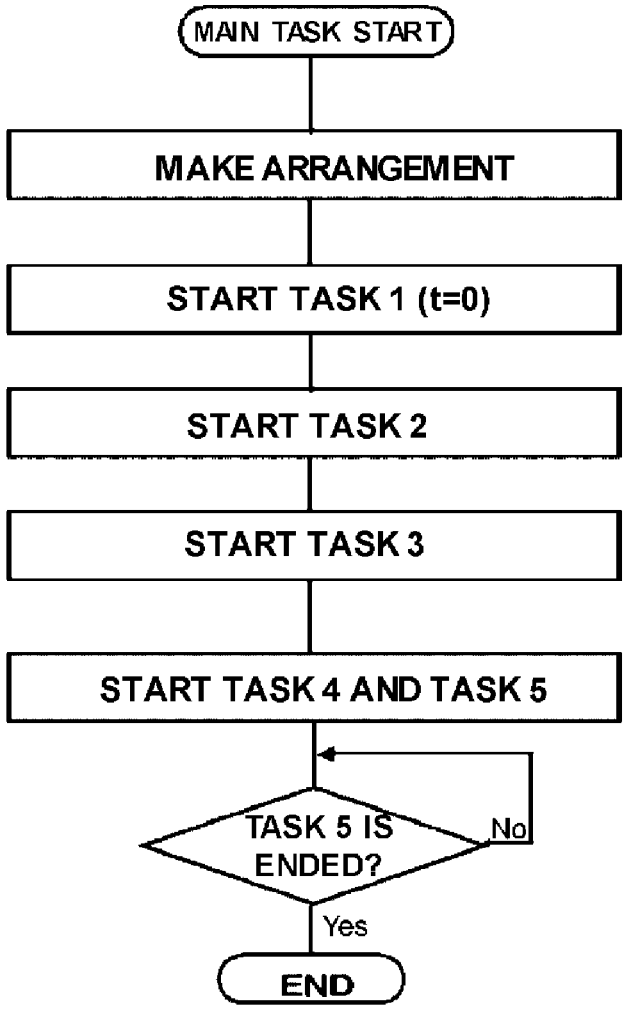
FIG. 5 illustrates a flowchart of control.
Figure 6:
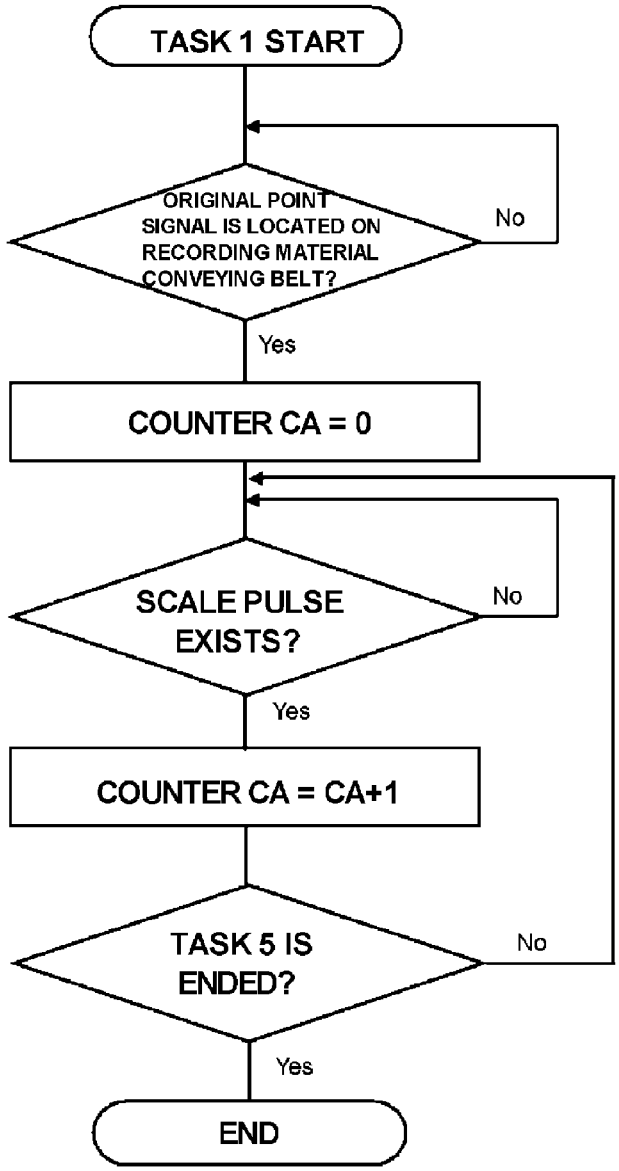
FIG. 6 is a flowchart illustrating control of a task 1.
Figure 7:
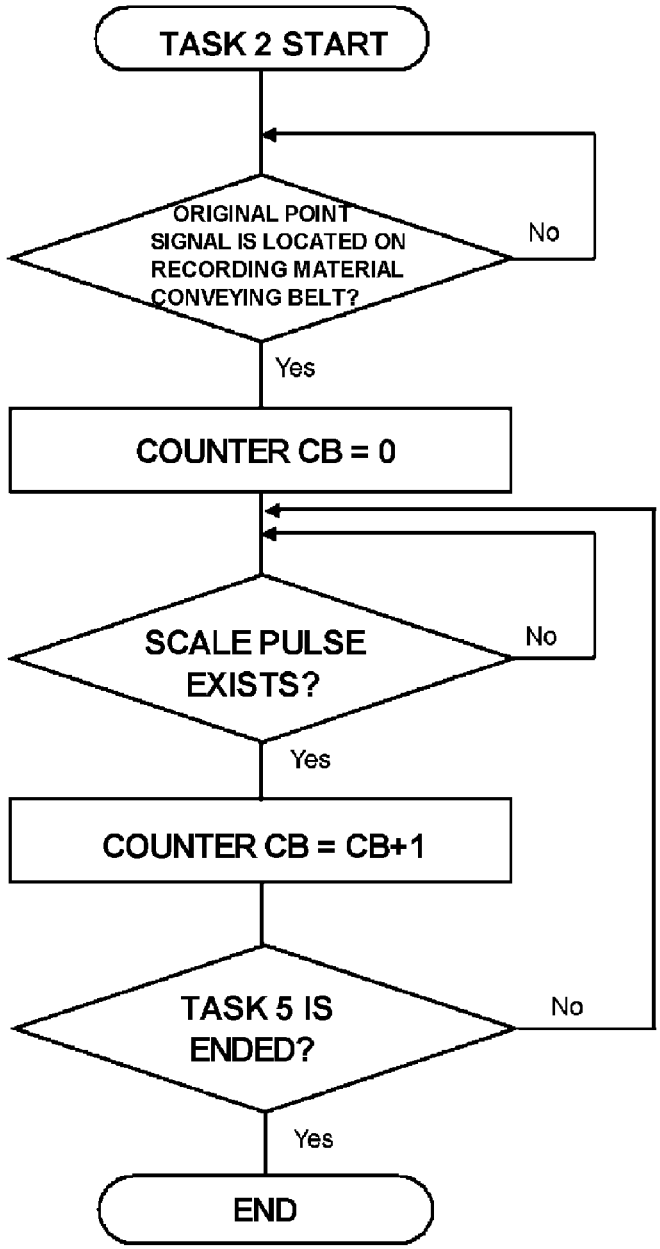
FIG. 7 is a flowchart illustrating control of a task 2.
Figure 8:
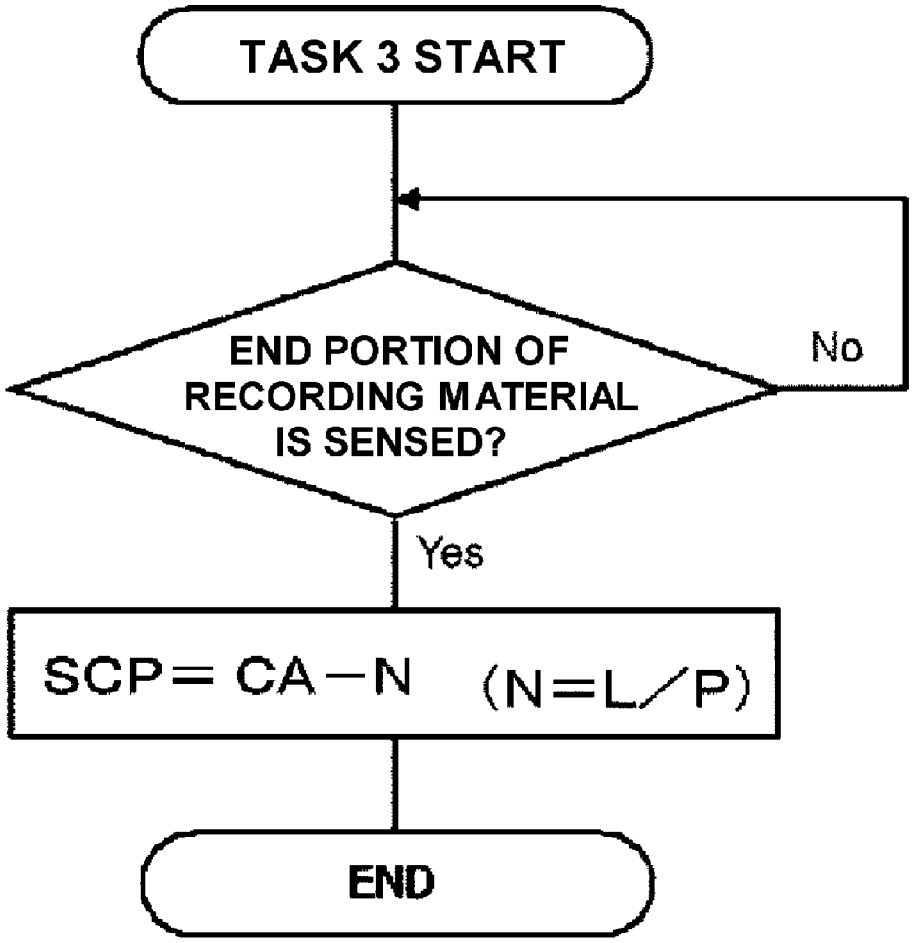
FIG. 8 is a flowchart illustrating control of a task 3.
Figure 9:
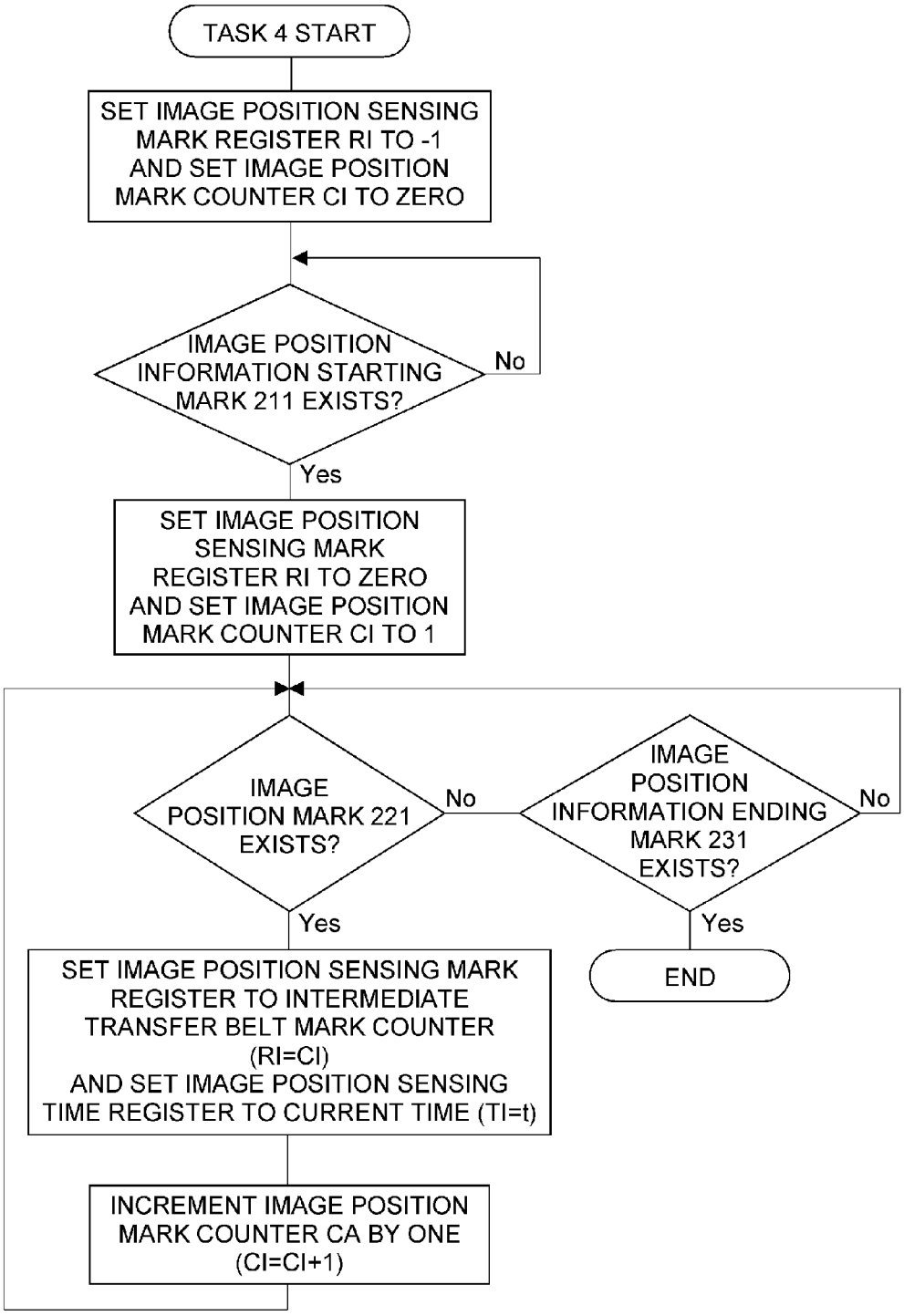
FIG. 9 is a flowchart illustrating control of a task 4.
Figure 10:
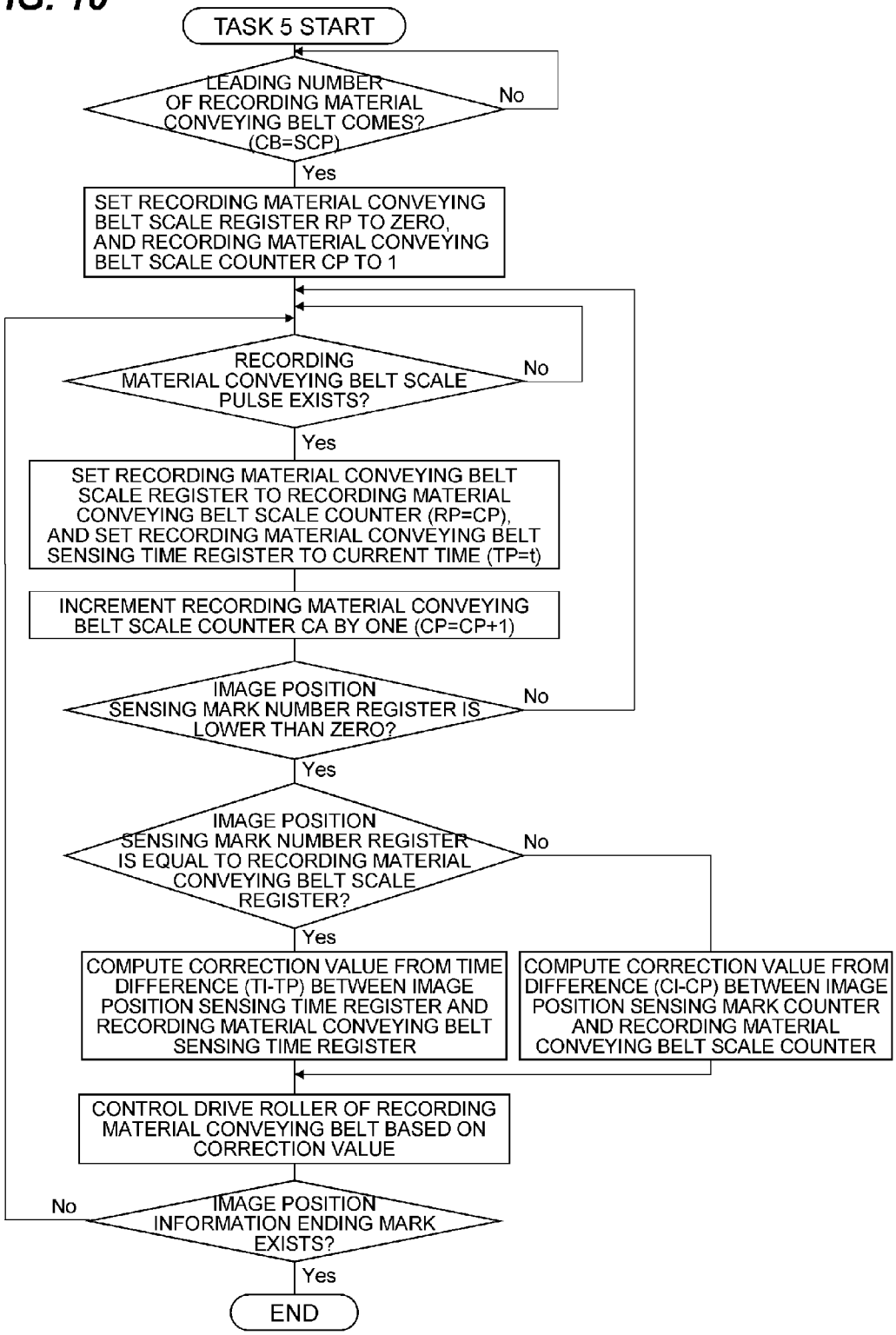
FIG. 10 is a flowchart illustrating control of a task 5.

A specific control method will be described below with reference to flowcharts of FIGS. 5 to 10. FIG. 5 is a flowchart illustrating the control of FIG. 4. FIG. 6 is a flowchart illustrating control of a task 1. FIG. 7 is a flowchart illustrating control of a task 2. FIG. 8 is a flowchart illustrating control of a task 3. FIG. 9 is a flowchart illustrating control of a task 4. FIG. 10 is a flowchart illustrating control of a task 5.

As illustrated in FIG. 5, in a main task, the whole of the image forming apparatus is started up to make arrangement. Specifically, the start-up of the whole of the image forming apparatus means start-up of the laser scanner, start-up of the rotation of the photosensitive drum, start-up of the running of the intermediate transfer belt, start-up of the running of the recording material conveying belt, and the voltage application to the transfer roller. Then a task 1, a task 2, a task 3, a task 4, and a task 5 are sequentially performed.

As illustrated in FIG. 6, in the task 1, the end-portion sensor 41 and the read head 92 count the equal pitch scale 91 on the recording material conveying belt 9 from a reference original point. When a signal of an original point on the recording material conveying belt is detected, the read head 92 reads the scale number in each pulse.

As illustrated in FIG. 7, in the task 2, the read head 93 counts the equal pitch scale 91 from the reference original point. When the reference original point is detected, the read head 93 reads the scale number in each pulse.

As illustrated in FIG. 8, in the task 3, the end portion of the recording material is detected to determine the leading scale number in which the scale matching starts. In FIG. 8, the letter L designates a predetermined distance in which the control starts in advance of the image to be formed, and the letter P designates a scale pitch on the recording material conveying belt.

When the scale matching starts after the image and the recording material reach the secondary transfer position, the secondary transfer is performed while the normal scale matching cannot be performed until scales are matched with each other. That is, the secondary transfer is performed while a large control deviation remains.

In the first embodiment, the scale matching control starts from the position located ahead by the distance L before the image and the recording material reach the secondary transfer position. Therefore, the normal scale matching control can be performed when the image and the recording material reach the secondary transfer position. That is, the secondary transfer can be performed while the control deviation is reduced. This is the reason the scale number (SCP) located ahead by the distance L from the end portion of the recording material is determined.

As illustrated in FIG. 9, in the task 4, the image position scale 200 (intermediate transfer belt mark) on the intermediate transfer belt 1 is read in the secondary transfer position. As illustrated in FIG. 2, the image position information starting mark 211 is recorded in front of the image region. The position in which the image position information starting mark 211 is recorded corresponds to the distance L from the end portion of the recording material. The scale number and the time the scale number is detected are sequentially recorded from the image position information starting mark 211 in an image position sensing mark register and an image position sensing time register.

The control is performed to all the image position marks 221 until the image position information ending mark 231 is detected.

As illustrated in FIG. 10, in the task 5, at the secondary transfer position, a value read from the equal pitch scale 91 on the recording material conveying belt 9 and a value read from the image position scale 200 on the intermediate transfer belt 1 are compared to control the drive of the recording material conveying belt 9.

First, when a counter CB of the read head 93 reach the scale matching starting number (SCP), the scale number and the time the scale number is detected are sequentially recorded in a recording material conveying belt scale register and a recording material conveying belt sensing time register.

Then the numbers of the image position sensing mark register and the recording material conveying belt scale register, recorded in the task 4, are compared to each other.

When the number of the recording material conveying belt scale register is larger than the number of the image position sensing mark register, the recording material conveying belt advances from the correct position with respect to the image. Therefore, the rotating speed of the control motor coupled to the recording material conveying belt drive roller is reduced according to the difference between the numbers.

When the number of the recording material conveying belt scale register is smaller than the number of the image position sensing mark register, the recording material conveying belt delays from the correct position with respect to the image. Therefore, the rotating speed of the control motor coupled to the recording material conveying belt drive roller is enhanced according to the difference between the numbers.

When the numbers of the image position sensing mark register and the recording material conveying belt scale register are matched with each other by the comparison of the numbers, the time of the image position sensing time register and the time of the recording material conveying belt sensing time register are compared to each other.

When the time of the recording material conveying belt sensing time register is earlier than the time of the image position sensing time register, the recording material conveying belt advances from the correct position with respect to the image. Therefore, the rotating speed of the control motor coupled to the recording material conveying belt drive roller is reduced according to the time difference.

When the time of the recording material conveying belt sensing time register is later than the time of the image position sensing time register, the recording material conveying belt delays the correct position with respect to the image. Therefore, the rotating speed of the control motor coupled to the recording material conveying belt drive roller is enhanced according to the time difference.

The task is ended when the image position information ending mark 231 is detected.

As described above, the leading end of the print image and the front end of the recording material can accurately be matched with each other by performing the control based on the detection results of the two position indexes. Even if the print image on the intermediate transfer belt 1 expands or shrinks in the sub-scanning direction due to the rotating speed fluctuation of the photosensitive drum or the speed fluctuation of the intermediate transfer belt 1, the print image on the intermediate transfer belt 1 is matched with the equal pitch scale 91 on the recording material conveying belt 9. Therefore, the partial expansion and shrinkage of the toner image can be suppressed while the color toner images are accurately superimposed on one another in the transfer portion.

In the first embodiment, the first image is used as the image position scale, but the image position scale is not limited thereto. That is, any one of the second image, the third image, and the fourth image may be used as the image position scale.

In the first embodiment, the image position scale 200 on the intermediate transfer belt 1 is formed by transferring the scale of the toner image developed in the photosensitive drum 21 by the primary transfer, but the image position scale 200 is not limited thereto.

Alternatively, a latent image scale written in the photosensitive drum with the laser beam is directly transferred without developing the latent image scale using the toner by bringing the photosensitive drum and the intermediate transfer belt into contact with each other in the primary transfer portion, and the latent image scale may be formed on the intermediate transfer belt. At this point, a potential sensor such as a surface electrometer is used as the read head 72.

Alternatively, a magnetic recording layers are retained in the scale write regions of the photosensitive drum and intermediate transfer belt, and a magnetic mark may be recorded in a position corresponding to the laser beam scanning. In such cases, the magnetic mark is rewritten in the magnetic recording layer of the intermediate transfer belt at the same time as the print image is transferred in the primary transfer portion.

Alternatively, fixed scales may previously be prepared in the photosensitive drum and the intermediate transfer belt. In such cases, the scale address of the position corresponding to the laser beam scanning is recorded, and a scale address of the photosensitive drum is converted into a scale address of the intermediate transfer belt at the same time as the print image is transferred in the primary transfer portion.

The read head 92 and the end-portion sensor 41 may be removed when the accurate positioning of the recording material and the print image is not required. That is, the position of the end portion of the recording material is not brought into corresponding with the equal pitch scale 91 on the recording material conveying belt. Therefore, the pulse count value read by the read head 93 and the pulse count value read by the read head 72 are compared only from the times, and the rotation of the recording material conveying belt drive roller is adjusted such that the time difference is reduced. In such cases, advantageously the print image on the intermediate transfer belt is matched with the equal pitch scale on the recording material conveying belt, even if the print image on the intermediate transfer belt expands or shrinks in the sub-scanning direction due to the rotating speed fluctuation of the photosensitive drum or the speed fluctuation of the intermediate transfer belt.

In the first embodiment, the speed of the recording material conveying belt is controlled in order to match the scales with each other, but not limited thereto. Alternatively, the speed of the intermediate transfer belt may be controlled by the similar method. That is, signs of the comparison result of the scale count values and the comparison result of the times are inverted, and a motor control portion controls a motor coupled to the roller that drives the intermediate transfer belt.

At this point, desirably a buffering portion is provided in the intermediate transfer belt such that the speed of the primary transfer portion and the speed of the secondary transfer portion do not interfere with each other.

[Second Embodiment]

Figure 11:
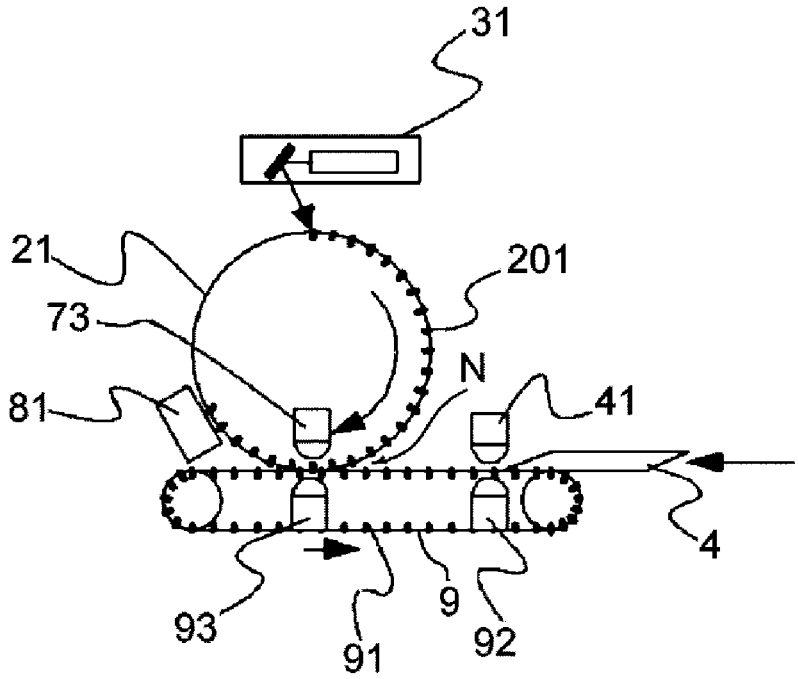
FIG. 11 is a schematic diagram illustrating an image forming apparatus according to a second embodiment of the invention.

FIG. 11 is a schematic diagram illustrating an image forming apparatus according to a second embodiment of the invention. The electrophotographic image forming apparatus of the second embodiment includes one photosensitive drum. In FIG. 11, the same configuration as the first embodiment is designated by the same numeral, and the description is omitted.

In the second embodiment, the image is directly transferred from the photosensitive drum 21 to the recording material in the transfer portion N of a monochrome machine. At this point, the rotation of the recording material conveying belt drive roller may be adjusted such that the equal pitch scale 91 on the recording material conveying belt 9 is matched with the image position scale 201 (toner image position index) on the photosensitive drum 21.

The sensor, the disposition of the read head, and the control flow of the second embodiment are similar to those of the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-310571, filed Dec. 5, 2009, which is hereby incorporated by reference herein in its entirety.

What is claimed is:

1. An image forming apparatus comprising:

a movable image bearing member that bears a toner image;

a transfer portion in which the toner image is transferred from the image bearing member to a recording material;

a movable conveying member that conveys the recording material to the transfer portion while moving integral with the recording material;

a first conveying member position index sensing member that senses a conveying member position index at a position close to the transfer portion, the conveying member position index formed on the conveying member as a periodic pattern along the moving direction of the conveying member;

an image position index sensing member that senses an image position index at a position close to the transfer portion, the image position index which is periodically formed on the image bearing member corresponds to the toner image from an upstream side of a leading end of the toner image;

a drive member capable of controlling a rotating speed of the conveying member;

a second conveying member position index sensing member that senses the conveying member position index at a position on an upstream side in the moving direction of the conveying member from the first conveying member position index sensing member;

an end-portion sensing member that senses a leading end of the recording material;

a selection portion which selects the conveying member position index corresponding to a first of the image position index in the moving direction of the image bearing member according to a sensing result of the second conveying member position index sensing member and the end-portion sensing member; and a control portion that controls the drive member to position the conveying member position index with respect to the image position index reaching the transfer portion based on the sensing results of the conveying member position index and the image position index.

2. The image forming apparatus according to claim 1, wherein the toner image position index is recorded as a difference in surface potential.

* * * * *